United States Patent [19]

Vlahakis

[11] 4,027,395

[45] June 7, 1977

[54] APPARATUS FOR ALIGNMENT OF PLAID FABRIC ON A CUTTING TABLE

[76] Inventor: Peter J. Vlahakis, 802 W. 181st St., New York, N.Y. 10033

[22] Filed: Aug. 30, 1976

[21] Appl. No.: 718,542

Related U.S. Application Data

[63] Continuation-in-part of Ser. No. 602,459, Aug. 6, 1975, abandoned.

[52] U.S. Cl. ..... 33/80; 33/11

[51] Int. Cl.[2] ..... B43L 5/02

[58] Field of Search ..... 33/2 R, 11, 16, 17 R, 33/76 R, 80, 103, 101; 83/453; 269/101

[56] References Cited

UNITED STATES PATENTS

| | | | |
|---|---|---|---|
| 1,292,654 | 1/1919 | Seghers | 33/103 |
| 2,692,433 | 10/1954 | Derna | 33/17 R |
| 2,713,204 | 7/1955 | Moore | 33/16 |

FOREIGN PATENTS OR APPLICATIONS

| | | | |
|---|---|---|---|
| 326,069 | 9/1919 | Germany | 33/80 |
| 81,613 | 4/1953 | Norway | 33/76 R |
| 1,204,850 | 9/1970 | United Kingdom | 33/76 R |

*Primary Examiner*—Charles E. Phillips
*Attorney, Agent, or Firm*—Joel Halpern

[57] ABSTRACT

Apparatus for the alignment of plaid fabric on a cutting table includes a pair of datum elements clampable to the opposite sides of a cutting table. The datum elements each have a transverse recess defined by parallel vertical faces. Each of the datum elements has a vertical slide bar and an adjustable slide clamp member slidably mounted thereon. A fabric alignment member made of rigid transparent material includes a pair of perpendicularly arranged elements each of which is provided with a plurality of guide lines which extend parallel to the lengthwise side edges of the element. Such alignment elements may be fixed or movable relative to each other. The fabric alignment member is positionable over the plaid fabric within the recesses of the opposed datum elements and clamps the fabric in place in alignment on the cutting table.

5 Claims, 5 Drawing Figures

APPARATUS FOR ALIGNMENT OF PLAID FABRIC ON A CUTTING TABLE

BACKGROUND OF THE INVENTION

The present application is a continuation-in-part of my application Ser. No. 602,459 filed Aug. 6, 1975, now abandoned, and claims the data thereof for all the common subject matter disclosed therein.

The present invention relates to apparatus for the alignment of fabric on a cutting table and more particularly to such apparatus for the alignment of plaid fabric.

In the manufacture of garments from plaid fabric it is desirable, in the production of high quality garments, to cut and sew garments in a manner that the pattern of the plaid fabric is in alignment throughout as much of the garment as is possible. However, in the past this has resulted in high labor costs and frequently necessitated substantial amounts of wasted fabric. The pinning of the plaid fabric in place for cutting was a time consuming operation which also contributed to the high cost of producing a quality garment.

U.S. Pat. No. 2,713,204 to Moore discloses a straight of goods finder including a rider and straight edge but makes no provision for clamping of the goods or pattern. The patentee instead follows the conventional method of pinning the goods and pattern.

SUMMARY OF THE INVENTION

It is one object of the invention to provide apparatus for alignment of plaid fabric on a cutting table which permits the production of a high quality garment with reduced labor.

It is another object of the invention to provide apparatus for alignment of plaid fabric on a cutting table with greater speed and without the need for pins on the cutting table.

It is still another object of the invention to provide apparatus for the alignment of plaid fabric on a cutting table which permits the clamping of fabric and pattern and facilitates the cutting of multiple pieces of aligned fabric.

Other objects and advantages of the invention will become readily apparent from the following description of the invention.

In accordance with the present invention there is provided apparatus for the alignment of plaid fabric on a cutting table comprising in combination: a pair of datum elements detachably fastenable to opposed sides of a cutting table, each of the datum elements having a transverse recess therein defined by parallel vertical faces thereof, and each of the datum elements having first and second upstanding guide members, one on either side of the recess and respective slide clamp members carried slidably on the guide members, the slide clamp members being positionable vertically along the guide members and clampable at a desired elevation; and a fabric alignment member including a first elongated element made of rigid transparent material and dimensioned to slide snugly within the opposed recesses of the pair of datum elements and a second elongated element made of rigid transparent material connected operably to the first elongated element and extending perpendicularly thereof, the first elongated element being provided with a plurality of guide lines extending lengthwise thereof and parallel with the longitudinal side edges thereof, and the second elongated elements being provided with a plurality of guide lines extending lengthwise thereof and parallel with the side edges thereof; whereby upon fastening of the pair of datum elements to the opposed sides of a cutting table and positioning the first elongated element of the fabric alignment member within the recesses of the datum elements and the fabric alignment member over a plaid fabric the slide clamp members are lowerable so as to clamp the fabric alignment member and the underlying fabric in place in proper alignment for cutting of the plaid fabric.

BRIEF DESCRIPTION OF THE DRAWINGS

In order that the invention may be more fully understood it will now be described, by way of example, with reference to the accompanying drawings, in which.

DETAILED DESCRIPTION OF THE INVENTION

Figure 1:
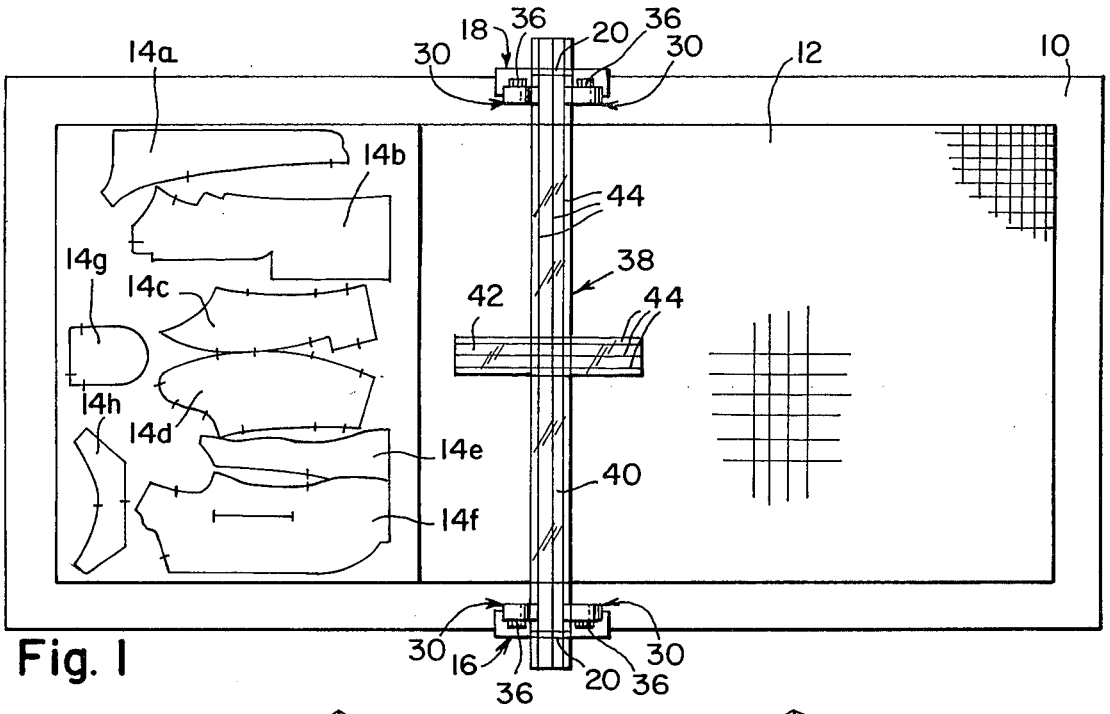
FIG. 1 is a plan view of a cutting table upon which there is positioned a plaid fabric, the patterns to be employed and the fabric alignment apparatus of this invention.
Figure 2:
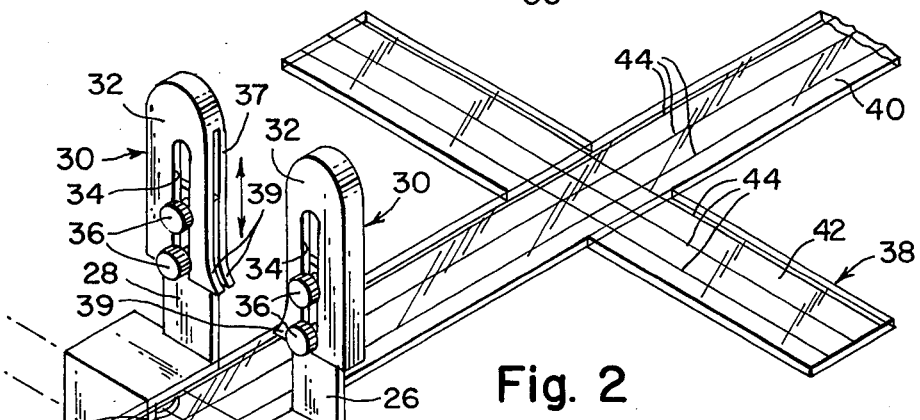
FIG. 2 is a perspective view of the plaid fabric alignment apparatus of this invention.
Figure 5:
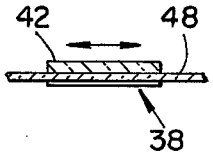
FIG. 5 is a cross-sectional view of the slidable alignment element in relation to the cooperable fabric alignment element taken along line 5—5 of FIG. 3.

Referring to the drawings there is shown a cutting table 10 upon which there is placed a length of textile fabric 12 having thereon a plaid fabric pattern. As will be appreciated by persons having skill in the garment industry the fabric may be woven or knot or otherwise formed and the plaid pattern may be either imprinted upon the raw fabric or the fabric may be initially produced with the yarns thereof so combined as to form the plaid pattern. It is also to be understood that a plurality of such lengths of fabric may be superimposed one upon the other for the cutting operation.

A plurality of patterns 14*a–h* are arranged upon the fabric where the pattern is properly aligned on the cutting table and the various parts of the garment are then cut from the fabric.

The apparatus of the invention is shown including a pair of datum elements 16, 18 which are fastenable detachably to opposite sides of the cutting table. Each of the datum elements is provided with a transverse recess 20 which is defined by a pair of opposed parallel vertical faces 22, 24. Such vertical faces are formed in the datum elements such that when the datum elements are secured to the sides of the cutting table by screw clamps 25 (known per se) they will extend perpendicularly to such sides. The lateral width of the recess is so dimensioned as to slidably and snugly receive an element of a fabric alignment member therewithin.

Each of the datum elements is given first and second upstanding guide members 26, 28. Each of the guide members carries slidably thereon a clamp member 30 which may be positioned at any desired height. The clamp members are desirably formed with a longitudinally extending internal slot or hollow portion which is so dimensioned as to permit the clamp member to be slid vertically along the guide member. The side faces 32 are each given a longitudinal slot 34 which extends from said side face inwardly to the inner slot. In order to lock the clamp member in its desired vertical position the underlying guide member may be provided with at least one fastening means 36 such as a screw which projects outwardly to extend beyond the slotted face of the clamp member and a nut which can be tightened onto the screw. The inner faces 37 of the clamp members are formed at the lower extremities thereof with projections 39 adapted to overlie a portion of the fabric alignment member to be described so as to clamp the alignment member in position. Alternatively, tapped holes may be provided in the guide members and cap screws may be screwed thereinto in order to lock the clamp members in place.

Figure 4:
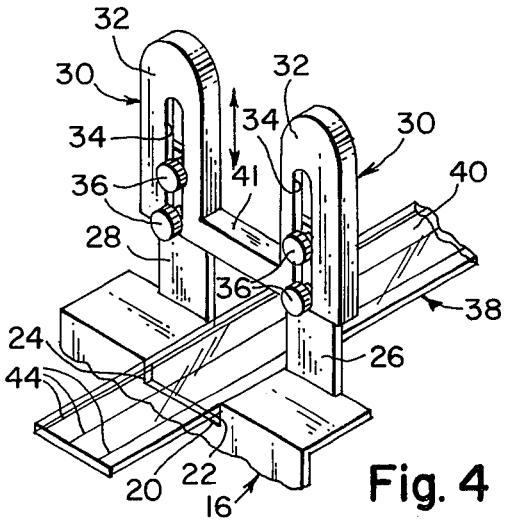
FIG. 4 is a view similar to that of FIG. 2 showing an alternate arrangement of the clamp members for the fabric alignment member.

As depicted in FIG. 4, the clamp members 30 may be part of a unitary assembly which is slidable on guide members 26, 28. A transverse clamping bar 41 extends between the clamp members at their lower extremities and serves the same function as projections 39, i.e., to clamp the fabric alignment member in position. The clamp bar also serves to connect the clamp members 30 so that they slide as a unit along the guide members.

Figure 3:
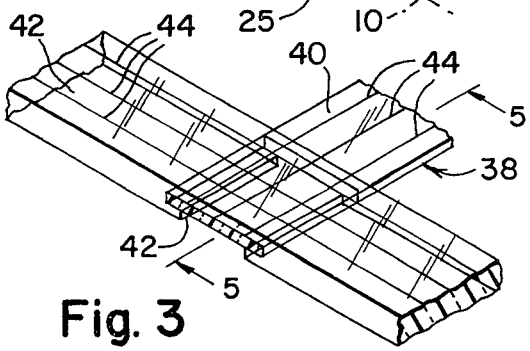
FIG. 3 is a fragmentary perspective view, partly in cross-section, showing a preferred construction for operably connecting the elements of the fabric alignment member movably relative to each other.

A fabric alignment member 38 is provided including a pair of perpendicularly connected elements 40, 42. A first of such elements 40 is of sufficient length to extend across the table and is laterally dimensioned to slide snugly within the opposed recesses of the opposed datum elements. The second of such elements 42 is connected to the element 40 so as to constitute a unitary assembly therewith. However, as shown in FIG. 3, it is within the ambit of the invention to construct the second element 42 so that it may slide longitudinally along the first element 40. As depicted in FIG. 3, element 42 may be provided with a channel 43 dimensioned to fit slidably over fabric alignment element 40 so that element 42 can be positioned at any desired location along the length of element 40. Both of elements 40 and 42 are made of a rigid transparent material and both are provided with a plurality of parallel guide lines 44. The guide lines extend lengthwise of each alignment element.

In operation, the pair of datum elements are secured to the opposite sides of a cutting table by means of screw clamps 25 in exact alignment such that the vertical faces of the recess of each datum element are accurately aligned across the table with the corresponding vertical faces of the recess in the opposed datum element. When so aligned the textile fabric with the plaid design is placed upon the table. The clamp members of each guide member are raised so that the alignment member can be positioned atop the fabric and fitted within the opposed recesses of the datum elemens. With the alignment member thus loosely in place in the datum elements the fabric is oriented such that the lines of the plaid pattern are brought into eact alignment with the guide lines 44 in elements 40 and 42. When utilizing a fabric alignment member as shown in FIG. 3 the slidable element 42 may be moved to the desired position along element 40. When so oriented the clamp members 30 are lowered to clamp the alignment member and the underlying textile fabric to the table in proper oriented position. The patterns 14*a–h* are then located on the surface of the fabric and cutting of the fabric can commence in the usual manner. It is also possible, if desired, to clamp the patterns and fabric beneath the fabric alignment member. The fabric thus cut has been so positioned with respect to the datum elements and the alignment member that, assuming the patterns are properly matched to the pattern of the fabric, the plaid should match over as much of the garment as is possible thereby resulting in the production of a high quality garment with a minimum of time spent in alignment of the fabric to accomplish proper orientation of the plaid pattern in each of the patterns employed.

I claim:

1. Apparatus for the alignment of plaid fabric on a cutting table comprising in combination:

a pair of datum elements detachably fastenable to opposed sides of a cutting table, each of said datum elements having a transverse recess therein defined by parallel vertical faces thereof, and each of said datum elements having first and second upstanding guide members one on either side of said recess and respective slide clamp members carried slidably on said guide members, said slide clamp members being positionable vertically along said guide members and clampable at a desired elevation;

and a fabric alignment member including a first elongated element made of rigid transparent material and dimensioned to slide snugly within the opposed recesses of said pair of datum elements and a second elongated element made of rigid transparent material connected operably to said first elongated element and extending perpendicularly thereof, said first elongated element being provided with a plurality of guide lines extending lengthwise thereof and parallel with the longitudinal side edges thereof, and said second elongated element being provided with a plurality of guide lines extending lengthwise thereof and parallel with the side edges thereof;

whereby upon fastening of said pair of datum elements to the opposed sides of a cutting table and positioning said first elongated element of said fabric alignment member within the recesses of said datum elements and the fabric alignment member over a plaid fabric the said side clamp members are lowerable so as to clamp the fabric alignment member and the underlying fabric in place in proper alignment for cutting of the plaid fabric.

2. Apparatus according to claim 1, wherein said second elongated element is connected to said first elongated element to be slidable therealong.

3. Apparatus according to claim 2, wherein said second elongated element is provided with a transversely extending channel-shaped recess adapted to slidably mount said second elongated element on said first elongated element.

4. Apparatus according to claim 1, wherein a transverse clamping bar is provided connecting the lower extremities of said slide clamp members, said clamping bar thereby being effective to effectuate the movement of said slide clamp members as a unitary assembly and to serve as the clamping surface engageable with said first elongated element of said fabric alignment member.

5. Apparatus according to claim 1, wherein each of said slide clamp members is formed with an internal slot adapted to permit such member to be positioned slidably on the associated upstanding guide member, each of said slide clamp members having a slot therein extending from the outer face thereof to said internal slot thereof, first fastening means being provided on each of said upstanding guide members adapted to project outwardly beyond the said outer face of the slide clamp member positioned thereon and cooperable with second fastening means to thereby secure said slide clamp members at a selected vertical position relative to the fabric alignment member.

* * * * *